United States Patent [19]

Yoshimura et al.

[11] 4,079,588

[45] Mar. 21, 1978

[54] INTERNAL COMBUSTION ENGINE

[75] Inventors: Tooru Yoshimura; Fumio Sanezawa, both of Yokosuka, Japan

[73] Assignee: Nissan Motor Company, Ltd., Japan

[21] Appl. No.: 690,598

[22] Filed: May 27, 1976

[30] Foreign Application Priority Data

Jun. 5, 1975 Japan ..... 50-76283[U]

[51] Int. Cl.[2] ..... F02M 25/00; F01N 3/10

[52] U.S. Cl. ..... 60/278; 60/282; 60/323; 123/193 H

[58] Field of Search ..... 60/278, 282, 323; 123/193 H

[56] References Cited

U.S. PATENT DOCUMENTS

| | | | |
|---|---|---|---|
| 2,257,631 | 9/1941 | Wahlberg | 60/323 |
| 3,768,787 | 10/1973 | Marsee | 60/278 |
| 3,969,893 | 7/1976 | Sakurai | 60/282 |

*Primary Examiner*—Douglas Hart

[57] ABSTRACT

An internal combustion engine is disclosed in which each pair of cylinders has a Siamese exhaust port. Each of the exhaust ports is designed so that the ratio of a surface area (F) exposed to the exhaust gas discharged from one of the cylinders to the minimum cross-sectional area (S) through which the exhaust gas flows (F/S) ranges from 3 to 6.

2 Claims, 3 Drawing Figures

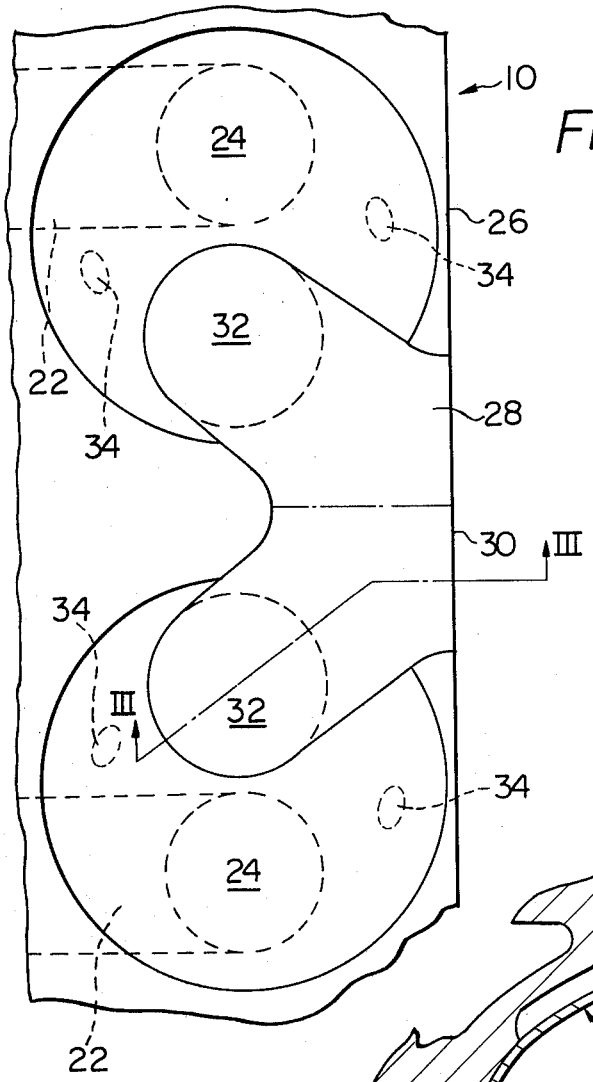
Fig. 2
Fig. 3
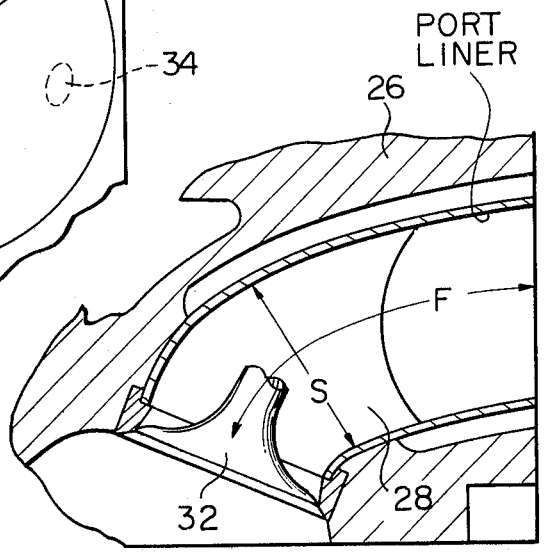

INTERNAL COMBUSTION ENGINE

The present invention relates to an internal combustion engine.

To reduce NOx emissions in the engine exhaust, it has been proposed to provide each cylinder with a plurality of spark plugs to shorten the flame travel so as to enable stable combustion of combustible mixture with high exhaust gas recirculation (EGR) rates by accelerating the combustion. Increasing the EGR rates will result in a corresponding reduction in NOx emissions, but will result in a deceleration in the combustion and a deterioration in HC control. The deceleration in the combustion is compensated for by the combustion with the plurality of spark plugs and HC and CO contents in the engine exhaust gas are treated by an exhaust converter, such as a thermal reactor or a catalytic converter. To promote oxidation reaction of HC and CO contents within the exhaust converter, the exhaust gas temperature must be maintained high.

To help the exhaust gas have sufficiently high temperature within the exhaust reactor, there are two possibilities.

One possibility consists of retarding the spark timings to increase the temperature of the exhaust gas as it leaves exhaust valves so as to compensate for possible loss in temperature within exhaust ports within cylinder head of the engine. However this results in losses in power and fuel economy of the engine. This possibility is not suitable for the combustion with multiple sparks and the high EGR rates because retarding the spark timing sufficiently to cause the desired temperature rise in the exhaust gas will cause rough combustion.

Another possibility consists of minimizing a heat loss by reducing the amount of heat transfer from the exhaust gas toward the cylinder head.

It is therefore a main object of the present invention to provide an internal combustion engine provided with exhaust ports by which a heat loss in the exhaust gas is minimized to facilitate the subsequent oxidation reaction of the exhaust gas within the exhaust reactor.

Based on the recognition that a heat loss will be minimized by reducing a surface area of each exhaust port exposed to the exhaust gas and increasing the minimum cross sectional area through which the exhaust gas flows because with increasing of the surface area the amount of heat transfer increases and with decreasing the cross sectional area the flow velocity of the exhaust gas increases, it is another object of the present invention to tailor design parameters of each exhaust port of the engine by which heat loss in the exhaust gas is minimized.

The present invention will be specifically described in the following paragraphs taken in conjunction with the accompanying drawings, in which:

FIG. 2 is a plan elevation, in diagram, of a part of a cylinder head of the engine shown in FIG. 1; and FIG. 3 is a sectional view taken through line III—III of FIG. 2.

Figure 1:
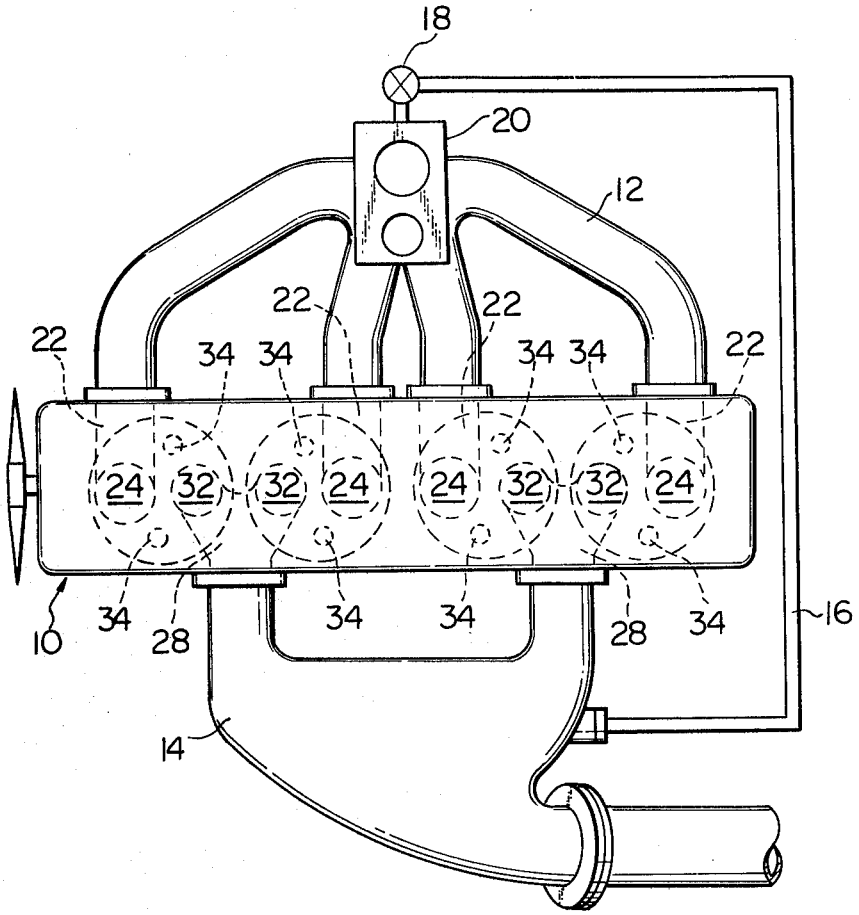
FIG. 1 is a schematic diagram of a four-cylinder internal combustion engine with an exhaust gas recirculation (EGR) system.

Referring to FIG. 1, reference numeral 10 designates an engine block having four cylinders, reference numeral 12 an intake manifold, reference numeral 14 an exhaust manifold including an exhaust converter, such as a thermal reactor, reference numeral 16 an exhaust gas recirculation (EGR) conduit and reference numeral 18 an EGR flow rate control valve.

The intake manifold 12, which distributes a combustible mixture from a carburetor 20 to the cylinders, splits into four branches to meet independent intake ports 22 which leads to respective intake valves 24 through a cylinder head 26.

As best seen in FIG. 2, each pair of cylinders has a Siamese exhaust port 28. Each of the exhaust ports extends from an outlet port 30 within the lateral side of the cylinder head 26 inwardly toward two exhaust valves 32 and it splits into two branches leading toward the respective two exhaust valves 32. The Siamese exhaust port 28 is designed so that the ratio of surface area F exposed to the exhaust gas discharged from one cylinder to the minimum cross sectional area S through which the exhaust gas flows (F/S) ranges from 3 to 6. In practice, the minimum cross sectional area (usually cross sectional area right after the exhaust valve) is taken as S and inner surface area of one of the two which are divided by dash and dot lines shown in FIG. 2 (see FIG. 3 also) is taken as F.

The preferred range just described of F/S ratio is determined from the following consideration based on various tests.

Theoretically, the less the F/S ratio is, the less is the amount of heat that is transmitted from the exhaust gas to the exhaust port. There is the structural limitation to increasing of S because the cross sectional area of the exhaust port must be determined with a certain relation with the size of the cylinder bore and the cross sectional area of the intake port and to shortening of the exhaust port to decrease F because the space must be provided for installation of the exhaust valve. Therefore the lower limit of the range is 3. The upper limit is 6 because selecting the F/S ratio at a greater value than 6 will result in little reduction in the amount of heat loss and besides the exhaust pressure increase becomes very high.

The exhaust gas discharged from the Siamese exhaust ports 28 is passed into the reactor within the exhaust manifold 14 (see FIG. 1) wherein HC and CO are oxidized.

Each cylinder is provided with two spark plugs 34 (see FIG. 1). The spark plugs 34 are located within areas which are disposed in the neighbourhood of two diagonal positions. The arrangement makes possible stable combustion of the combustible mixture with high EGR rates because combustion period is shortened by shortening the flame travel. As a result a considerable reduction in NOx emissions is made possible without deteriorating of the stable combustion. With this combustion arrangement, the stable combustion is possible with the EGR rate from 12 to 40 percent EGR. Preferably, the EGR rate should range from 12 to 25 percent EGR.

It will be observed from the preceding description and the accompanying drawings that the amount of heat transferred from the exhaust gas to the cylinder head has been effectively reduced by having each pair of cylinders to form a Siamese exhaust port to reduce surface area transmitting the heat and by selecting the F/S ratio of the exhaust port within the range from 3 to 6.

Comparison study has been made between the engine just discussed which is provided with Siamese exhaust ports, each being designed with its F/S ratio within the range from 3 to 6, and a conventional engine provided with independent exhaust ports. Usually in the production engines which employs independent exhaust ports, little care was paid in designing of the exhaust port for the F/S ratio and for most independent ports, their F/S ratio was approximately 7 according to the measurement by the inventors. As a result of the comparison study it has been recognized that a considerable gain in exhaust gas temperature as it leaves the cylinder head is obtained with the Siamese exhaust port, which has the F/S ratio within the range from 3 to 6, over that with the independent exhaust port. The maximum of the gain has been 100° C.

It will be appreciated that the gain in the exhaust gas temperature will facilitate oxidation processes of HC and CO in the exhaust reactor. The exhaust temperature as it leaves the cylinders of the engine during low load engine operating condition is not sufficiently high above 760° C, which is a temperature above which oxidation of CO is possible, and thus there was a sharp decline of rate of reduction in CO within the reactor. This decline is made moderate by the Siamese exhaust port.

Although, in the preceding embodiment, the thermal reactor is provided to oxidize HC and CO contents in the exhaust gas, any other means may replace the thermal reactor as far as it cause the oxidation of HC and CO under high exhaust gas temperature.

What is claimed is:

1. In an engine system:

an internal combustion engine comprising an even number of cylinders and a cylinder head closing said plurality of cylinders, said cylinder head having a plurality, half in number to said even number of cylinders, of Siamese exhaust port bores, each extending from an outlet port within a lateral side of said cylinder head inwardly toward two exhaust valves of adjacent two cylinders of said even number of cylinders and splitting into two branches leading toward said two exhaust valves, said cylinder head having a plurality of port liners mounted within said plurality of Siamese exhaust port bores, respectively, to define an exhaust gas flow passage;

a thermal reactor connected to said cylinder head to receive exhaust gases discharged from said outlet ports within the lateral side of said cylinder head, in which the ratio of a surface area exposed to exhaust gases flowing through each Siamese exhaust port bore to the minimum cross sectional area through which the exhaust gases pass ranges from 3 to 6.

2. An engine system as claimed in claim 1, in which said internal combustion engine has two spark plugs per each of said even number of cylinders, said two spark plugs of each cylinder being located within areas which are disposed in the neighbourhood of two diagonal positions, and in which means is provided to recirculate a portion of exhaust gases at a rate ranging from 12 to 40 percent EGR.

* * * * *